US011138917B2

(12) United States Patent
Choi

(10) Patent No.: US 11,138,917 B2
(45) Date of Patent: Oct. 5, 2021

(54) DISPLAY DEVICE AND MICRO-CONTROLLER UNIT FOR DATA COMMUNICATION

(71) Applicant: SILICON WORKS CO., LTD., Daejeon (KR)

(72) Inventor: Yong Woo Choi, Daejeon (KR)

(73) Assignee: SILICON WORKS CO., LTD., Daejeon (KR)

( * ) Notice: Subject to any disclaimer, the term of this patent is extended or adjusted under 35 U.S.C. 154(b) by 0 days.

(21) Appl. No.: 17/077,353

(22) Filed: Oct. 22, 2020

(65) Prior Publication Data

US 2021/0125536 A1 Apr. 29, 2021

(30) Foreign Application Priority Data

Oct. 24, 2019 (KR) ..... 10-2019-0132607

(51) Int. Cl.
*G09G 3/20* (2006.01)

(52) U.S. Cl.
CPC ..... *G09G 3/20* (2013.01); *G09G 2310/0267* (2013.01); *G09G 2310/0275* (2013.01); *G09G 2310/08* (2013.01); *G09G 2330/021* (2013.01)

(58) Field of Classification Search
None
See application file for complete search history.

(56) References Cited

U.S. PATENT DOCUMENTS 7,268,719 B2 * 9/2007 Terazawa ..... G04F 10/005 341/157
7,907,693 B2 * 3/2011 Bae ..... H03K 19/0966 375/371
9,582,441 B2 * 2/2017 Levy ..... G06F 1/06
2002/0131539 A1 * 9/2002 Li ..... H03L 7/087 375/355
2010/0146175 A1 * 6/2010 Choe ..... G09G 3/3688 710/110
2010/0225620 A1 * 9/2010 Lee ..... G09G 3/20 345/204
2019/0196532 A1 * 6/2019 Jang ..... G06F 1/12

FOREIGN PATENT DOCUMENTS

KR 10-2018-0042509 A 4/2018

* cited by examiner

*Primary Examiner* — Dorothy Harris
(74) *Attorney, Agent, or Firm* — Fenwick & West LLP

(57) ABSTRACT

The present disclosure, which relates to a data communication between a micro-controller and a source readout circuit, does not require a clock circuit of a slave, and thus, allows the size of a slave circuit and power consumption to be reduced.

19 Claims, 11 Drawing Sheets

DISPLAY DEVICE AND MICRO-CONTROLLER UNIT FOR DATA COMMUNICATION

CROSS REFERENCE TO RELATED APPLICATION

This application claims priority from Republic of Korea Patent Application No. 10-2019-0132607, filed on Oct. 24, 2019, which is hereby incorporated by reference in its entirety.

BACKGROUND

1. Field of Technology

The embodiments relate to a technique for data communication between a micro-controller unit and a source readout integrated circuit (IC).

2. Description of the Prior Art

A large amount of data may be transmitted and received between internal circuits in a display device. The data may include image data including information on images to be displayed on a panel or control data for controlling internal circuits in order to display the images. Hence, a protocol for transmitting and receiving data is also required. For example, the protocol may include details about whether communication is performed in a synchronization method or an asynchronization method, or details about the sequence in which data is exchanged in the case of the synchronization method for communication.

In general, data communication between internal circuits of a display device may be based on a serial peripheral interface (SPI) or an inter-integrated circuit (I2C). In the SPI or I2C scheme, if a clock is delayed by one cycle or more in the communication between a master and a slave, the master is unable to read received data. There may be limitations in increasing the communication speed in the SPI or I2C scheme because of concerns of the delay. In order to solve this problem, the slave may transmit data together with a clock to the master.

However, in order to transmit a clock, the slave must include a circuit for generating the clock therein. If the slave includes a clock circuit therein, the size of the slave circuit increases. In the SPI or I2C scheme, one master communicates with a plurality of slaves. In this case, if each of the plurality of slaves includes a clock circuit therein, the size of the display device may increase in the overall system.

In addition, since the clock circuit also consumes power, the power consumption may increase in proportion to the number of the provided clock circuits.

SUMMARY

In relation thereto, the embodiments are intended to provide a data communication method of a display device, which is improved to reduce the size of the circuit and to lower the power consumption.

An objective of the embodiment is to provide a technique in which a master restores data even if a slave transmits data to the master without a clock.

Another objective of the embodiment is to provide a technique in which a master restores data by sampling received data using a plurality of duplicate clocks having different phases therebetween.

Another objective of the embodiment is to provide a technique in which a master aligns data in units of bytes or words by adding a predetermined signal form to the data.

To this end, in an aspect, the present disclosure provides a display device comprising: a micro-controller unit configured to transmit a master signal together with a clock; and a source readout integrated circuit (IC) configured to restore master data from the master signal according to the clock and transmit a slave signal generated according to the clock to the micro-controller unit, wherein the micro-controller unit is configured to sample the slave signal according to a plurality of sampling clocks having the same frequency as that of the clock to generate a plurality of pieces of sampling data, and restore slave data using the plurality of pieces of sampling data.

In the display device, the plurality of sampling clocks may respectively have different phases.

In the display device, the source readout IC may not transmit a clock corresponding to the slave data.

In the display device, the micro-controller unit may sample the slave signal at rising edges or falling edges of the plurality of sampling clocks.

In the display device, the micro-controller unit may determine data, which occupies the majority of the plurality of pieces of sampling data, to be the slave data.

In the display device, the micro-controller unit may generate N sampling clocks (N is a natural number of 3 or more).

In the display device, N may be an odd number, and the micro-controller unit may compare the bit values of the plurality of pieces of sampling data, and determine a bit value occupying the majority of the bit values of the plurality of pieces of sampling data to be a bit value of the slave data.

In the display device, the plurality of sampling clocks may have a uniform phase difference therebetween.

In the display device, the micro-controller unit and the source readout IC may transmit and receive the clock through a signal line in which a delay occurs.

In the display device, the micro-controller unit may divide the slave signal into predetermined units, and samples the divided slave signal.

In the display device, the slave signal may comprise a pattern indicating a start time of a predetermined unit, and the micro-controller unit may divide the slave signal based on the pattern.

In the display device, the micro-controller unit may transmit a read command using the master data, and wait to receive the slave data after transmission of the read command.

In the display device, the slave data may be data in a serial form, and the micro-controller unit may convert the plurality of pieces of sampling data from the serial form into a parallel form, store the same in a storage unit, compare the data stored in the storage unit, and restore the slave data.

In the display device, one of the plurality of sampling clocks may be the clock.

In another aspect, the present disclosure provides a micro-controller unit for transmitting, to a slave device, a master signal together with a clock, the micro-controller unit comprising: a plurality of data aligning units configured to receive a slave signal from the slave device and generate sampling data by sampling the slave signal according to a sampling clock having the same frequency as that of the clock; and a data selecting unit configured to compare the sampling data generated by the plurality of data aligning units to restore slave data included in the slave signal.

In the micro-controller unit, the sampling clock may be the clock or a clock having a phase different from that of the clock.

In the micro-controller unit, the data aligning unit may sample the slave signal at rising edges or falling edges of the sampling clock.

The micro-controller unit may further comprise a storage unit in which the sampling data is stored and from which the sampling data is read out by the data selecting unit in a first-in-first-out (FIFO) manner.

In the micro-controller unit, the slave data may be data in a serial form, and the data aligning unit may convert the sampling data from the serial form into a parallel form, and store the same in the storage unit.

As described above, according to the embodiments, since a clock is not used in transmission of data from the slave to the master, a clock circuit of the slave is not required, and thus the size of the slave circuit is able to be reduced.

In addition, according to the embodiments, since the clock circuit of the slave is not required, the power consumption thereof is able to be reduced according thereto.

BRIEF DESCRIPTION OF THE DRAWINGS

The above and other aspects, features, and advantages of the present disclosure will be more apparent from the following detailed description taken in conjunction with the accompanying drawings, in which.

DETAILED DESCRIPTION

Figure 1:
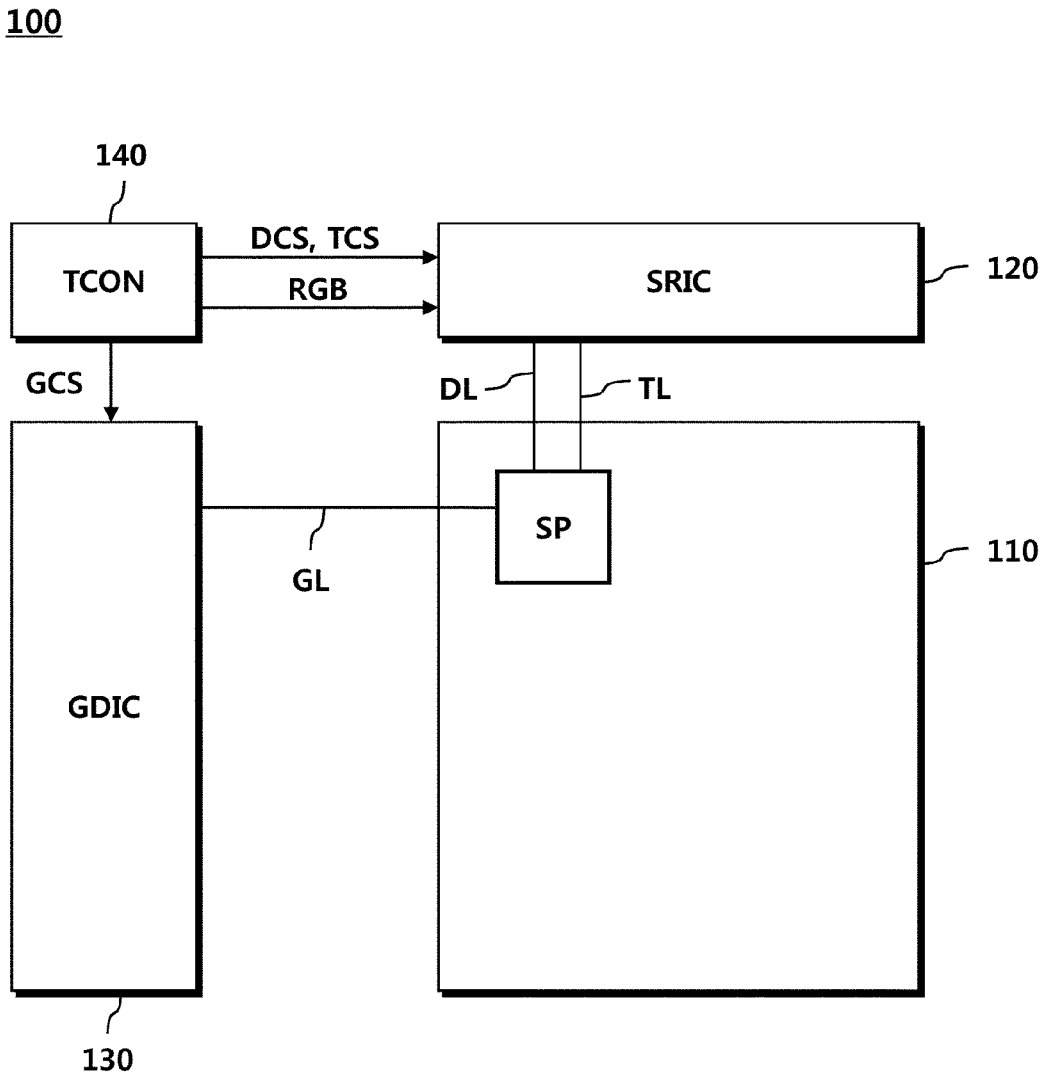
FIG. 1 is a diagram illustrating the configuration of a display device according to an embodiment.

FIG. 1 is a diagram illustrating the configuration of a display device according to an embodiment.

Referring to FIG. 1, a display device 100 may include a panel 110, a source readout IC (SRIC) 120, a gate driving IC (GDIC) 130, and a timing controller (TCON) 140.

The panel 110 may have a plurality of data lines DL and a plurality of gate lines GL, which are arranged thereon, and a plurality of pixels may be arranged on the panel 110. The pixel may include a plurality of subpixels SP. Here, the subpixel may be a red subpixel (R), a green subpixel (G), a blue subpixel (B), a white subpixel (W), or the like. One pixel may be configured as RGB subpixels SP, RGBG subpixels SP, RGBW subpixels SP, or the like. Hereinafter, for convenience, a description will be made on the assumption that one pixel is configured as RGB subpixels SP.

The source readout IC 120, the gate driving IC 130, and the timing controller 140 are devices that generate signals for displaying images on the panel 110.

The gate driving IC 130 may supply a gate driving signal of a turn-on voltage or a turn-off voltage to the gate lines GL. If a gate driving signal of a turn-on voltage is supplied to the subpixel SP, the subpixel SP is connected to the data line DL. In addition, if a gate driving signal of a turn-off voltage is supplied to the subpixel SP, the connection between the subpixel SP and the data line DL is released.

The source readout IC 120 may include a source driver therein. The source driver may supply a data voltage to the subpixel SP through the data line DL. The data voltage supplied to the data line DL may be supplied to the subpixel SP according to the gate driving signal.

In addition, the source readout IC 120 may include a readout IC (ROIC) therein. The readout IC may be embedded in the source readout IC 120 together with the source driver. The readout IC may sense a touch input by driving electrodes around the subpixel SP. The source readout IC 120 may drive the electrode through a touch line TL, and may receive an analog signal output from the electrode.

The source readout IC 120 may be connected to a bonding pad of the panel 110 by a tape automated bonding (TAB) type or a chip-on-glass (COG) type, or may be formed directly on the panel 110, and according to an embodiment, the source readout IC 120 may be formed to be integrated on the panel 110. In addition, the source readout IC 120 may be implemented by a chip-on-film (COF) type.

The timing controller 140 may supply control signals to the gate driving IC 130 and the source readout IC 120. For example, the timing controller 140 may transmit, to the gate driving IC 130, a gate control signal GCS for starting scanning. In addition, the timing controller 140 may output image data RGB to the source readout IC 120. In addition, the timing controller 140 may transmit a data control signal DCS that controls the source readout IC 120 to supply a data voltage to each of the subpixels SP. In addition, the timing controller 140 may transmit a touch control signal TCS for controlling the source readout IC 120 to drive the electrode of each subpixel SP and to sense a touch input.

Figure 2:
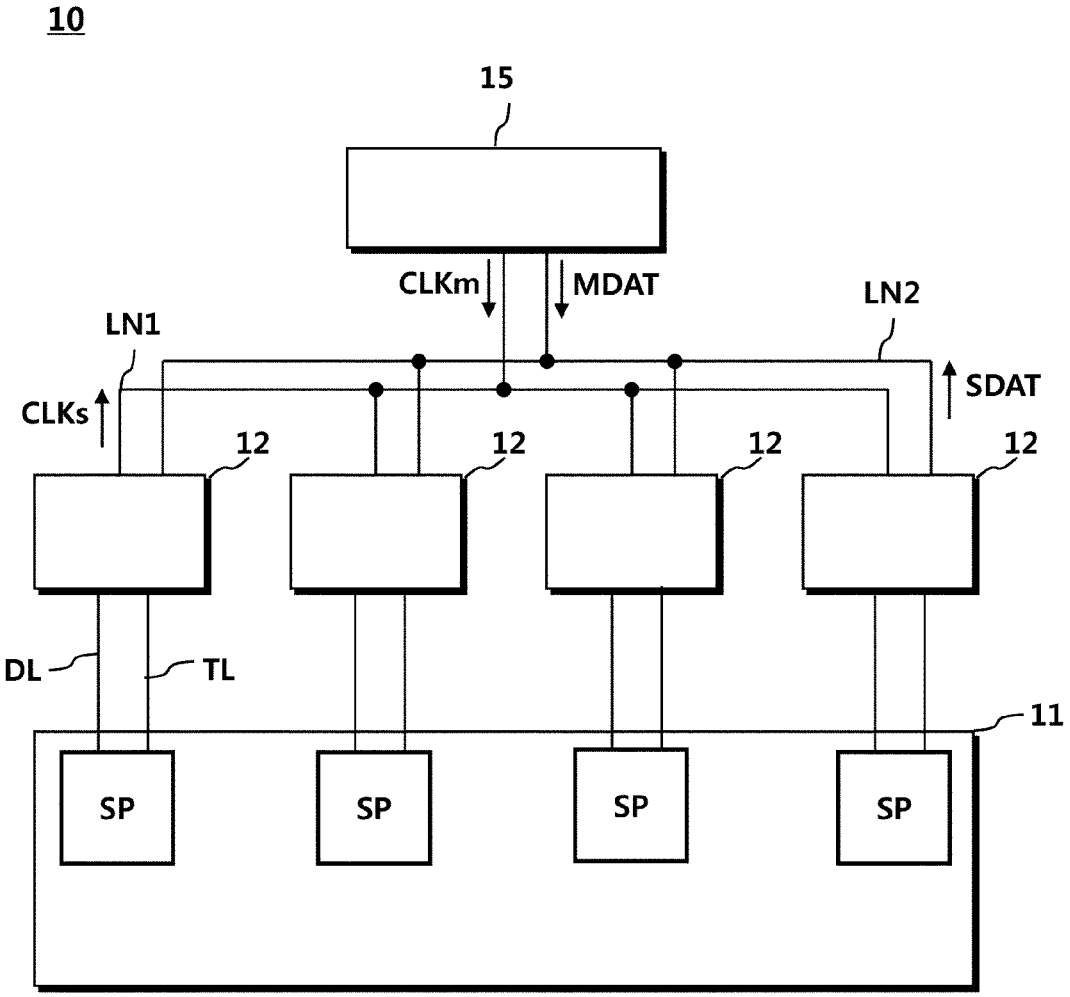
FIG. 2 (Related Art)
FIG. 2 is a diagram illustrating connections of a micro-controller unit, source readout ICs, and a panel in the related art.

FIG. 2 is a diagram illustrating connections of a micro-controller unit, source readout ICs, and a panel in the related art.

Referring to FIG. 2, the conventional display device 10 may further include a micro-controller unit (MCU) 15. A plurality of source readout ICs 12 may be configured to be included in the display device 100.

The micro-controller unit 15 and the source readout ICs 12 may communicate with each other based on a serial peripheral interface (SPI) scheme or an inter-integrated circuit (I2C) scheme. In the SPI or I2C scheme, the communication entities may operate as a master and a slave, that is, the micro-controller unit 15 may operate as a master and the plurality of source readout ICs 12 may operate as slaves.

A first communication line LN1 and a second communication line LN2 may be differential signal lines, which are configured as two signal lines, or may be a single signal line operating in an open-drain manner.

The micro-controller unit 15 may transmit master clock CLKm to the plurality of source readout ICs 12 through the first communication line LN1. The master clock CLKm may be generated by the micro-controller unit 150. The master clock CLKm may be synchronized with master data MDAT, and the master data MDAT may be transmitted in accordance with the master clock CLKm. In addition, the plurality of source readout ICs 12 may transmit slave clocks CLKs to the micro-controller unit 15 through the first communication line LN1. The slave clock CLKs may be generated by the source readout IC 12. The slave clock CLKs may be synchronized with slave data SDAT, and the slave data SDAT may be transmitted in accordance with the slave clock CLKs.

The micro-controller unit 15 may transmit master data MDAT to the plurality of source readout ICs 12 through the second communication line LN2. The master data MDAT may be the data transmitted from the micro-controller unit 15, which is a master, to the source readout IC 12. In addition, a plurality of source readout ICs 12 may transmit slave data SDAT to the micro-controller unit 15 through the second communication line LN2. Here, the slave data SDAT may be synchronized with the slave clock CLKs of the first communication line LN1. In addition, the slave data SDAT may be the data transmitted from the plurality of source readout ICs 12, which are slaves, to the micro-controller unit 15.

As described above, a method of synchronizing the clock (e.g., the master clock CLKm and the slave clock CLKs) with data (e.g., the master data MDAT and the slave data SDAT) in the bidirectional communication may require a circuit for producing a clock in the slave. In the case of a plurality of slaves, if there are clock circuits for the respective slaves, the overall size of the circuit may be increased due to these clock circuits.

Meanwhile, the plurality of source readout ICs 12 may be connected to the panel 11. The respective source readout ICs 12 may be allocated to uniformly divided areas in the panel 11, and may be connected to the subpixels SP in the allocated areas through the data lines DL and the touch lines TL.

Figure 3:
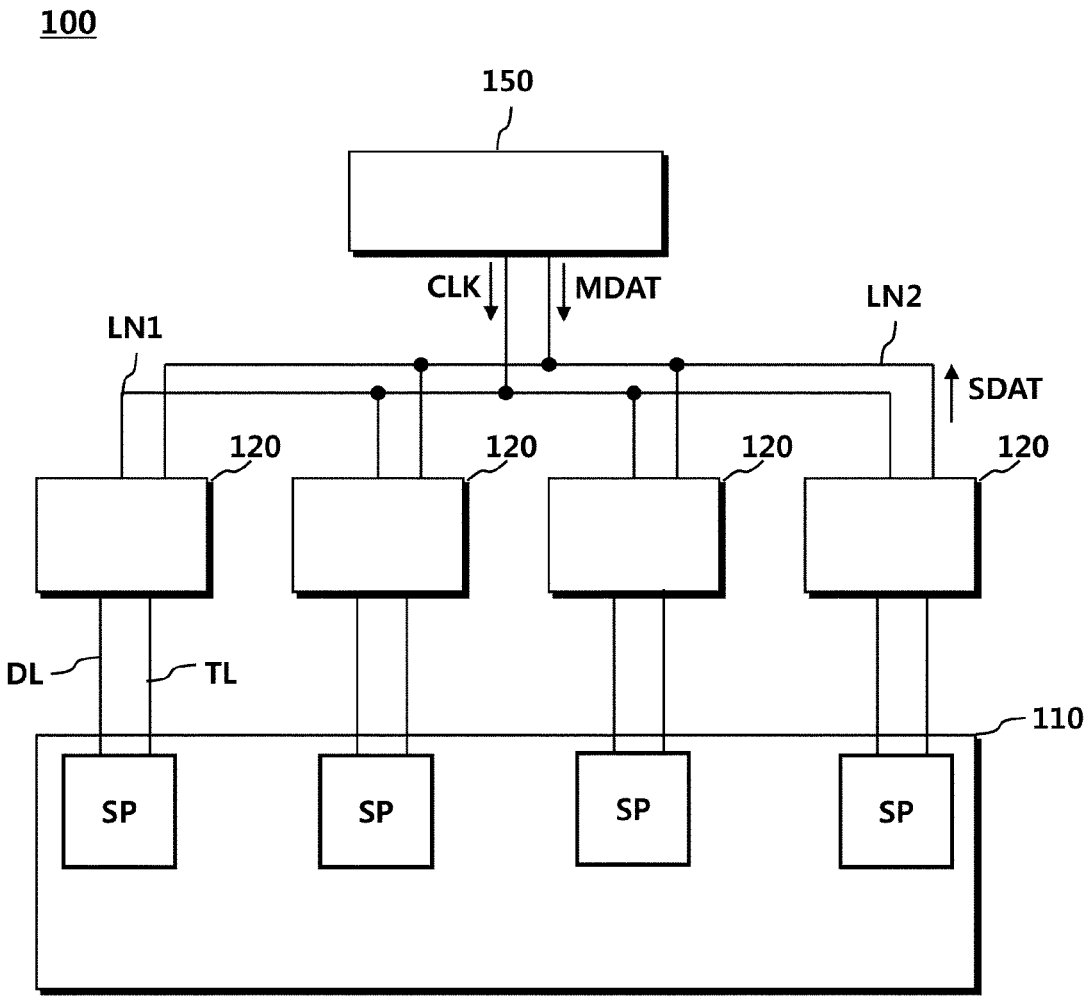
FIG. 3 is a diagram illustrating connections of a micro-controller unit, source readout ICs, and a panel according to an embodiment.

FIG. 3 is a diagram illustrating connections of a micro-controller unit, source readout ICs, and a panel according to an embodiment.

Referring to FIG. 3, a display device 100 according to an embodiment may not include a clock transmitted from a plurality of source readout ICs 120, which are slaves, to a micro-controller unit 150. That is, the communication from the slave to the master may be performed without synchronization of a clock.

The micro-controller unit 150 may transmit a clock CLK to the plurality of source readout ICs 120 through a first communication line LN1. The clock CLK may be generated by the micro-controller unit 150. The clock CLK may be synchronized with master data MDAT, and the master data MDAT may be transmitted in accordance with the clock CLK. However, the source readout ICs 120 may not transmit any clock to the micro-controller unit 150 through the first communication line LN1.

The micro-controller unit 150 may transmit master data MDAT to the plurality of source readout ICs 120 through a second communication line LN2. In addition, the plurality of source readout ICs 120 may transmit slave data SDAT to the micro-controller unit 150 through the second communication line LN2. Here, the slave data SDAT may not be synchronized with the clock.

As described above, if the clock is not used in the communication from the slave to the master during the bidirectional communication, the slave may not require a circuit for producing the clock. Accordingly, since the clock circuit is not present, the slave circuit may become smaller.

Figure 4:
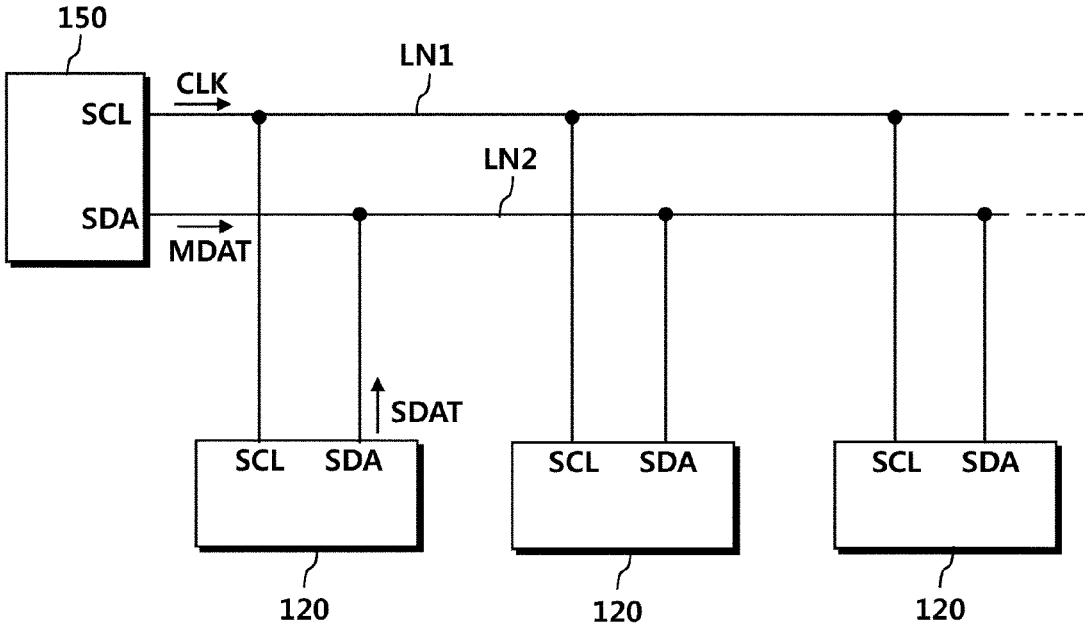
FIG. 4 is a diagram illustrating a first example of communication between a micro-controller unit and a source readout IC according to an embodiment.

FIG. 4 is a diagram illustrating a first example of communication between a micro-controller unit and a source readout IC according to an embodiment.

Referring to FIG. 4, the micro-controller unit 150 and the source readout IC 120 may communicate based on an I2C scheme. In the I2C communication, the micro-controller unit 150 may operate as a master, and a plurality of source readout ICs 120 may operate as slaves. In FIG. 3, the communication between the micro-controller unit 150 and the source readout IC 120 may be performed by an I2C scheme.

A first communication line LN1 and a second communication line LN2 may connect the micro-controller unit 150 and the plurality of source readout ICs 120. The first communication line LN1 and the second communication line LN2 may be configured as a common bus.

The micro-controller unit 150 may transmit a clock CLK to the source readout ICs 120 through an SCL terminal. In addition, the micro-controller unit 150 may transmit master data MDAT to the source readout ICs 120 through an SDA terminal. On the other hand, the source readout ICs 120 may transmit slave data SDAT to the micro-controller unit 150 through an SDA terminal.

Figure 5:
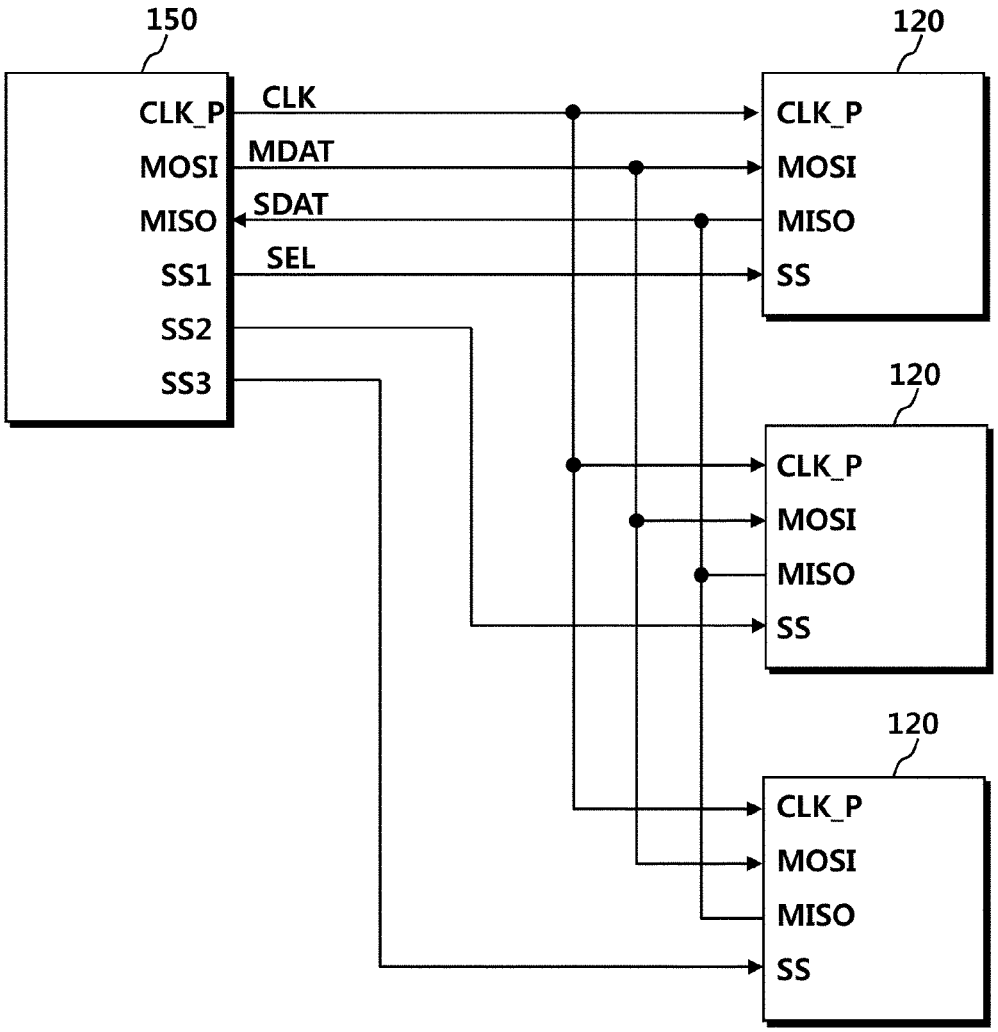
FIG. 5 is a diagram illustrating a second example of communication between a micro-controller unit and a source readout IC according to an embodiment.

FIG. 5 is a diagram illustrating a second example of communication between a micro-controller unit and a source readout IC according to an embodiment.

Referring to FIG. 5, the micro-controller unit 150 and the source readout IC 120 may communicate based on a serial peripheral interface (SPI) scheme. In the SPI communication, the micro-controller unit 150 may operate as a master, and a plurality of source readout ICs 120 may operate as slaves.

The micro-controller unit 150 may transmit a clock CLK to the source readout ICs 120 through a CLK_P terminal. In addition, the micro-controller unit 150 may transmit master data MDAT to the source readout ICs 120 through a MOSI terminal. In addition, the source readout ICs 120 may transmit slave data SDAT to the micro-controller unit 150 through a MISO terminal. In addition, the micro-controller unit 150 may transmit a selection signal SEL to the source readout ICs 120 through an SS terminal, thereby selecting one of the plurality of source readout ICs 120 for transmission and reception of data.

Here, the communication line for transmitting the clock CLK, the master data MDAT, and the slave data SDAT may be configured as a common bus.

Figure 6:
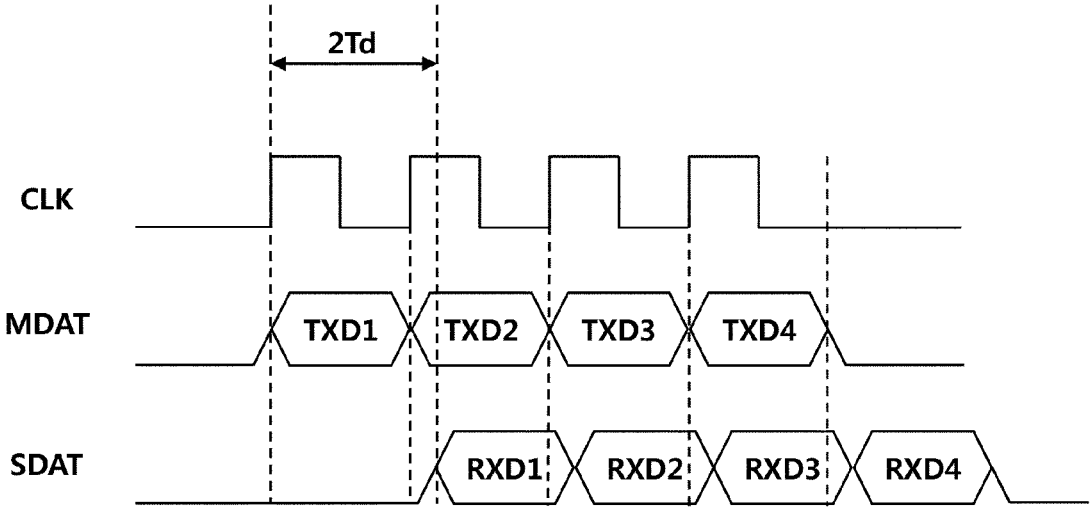
FIG. 6 is a diagram illustrating waveforms of clocks and data transmitted and received between a micro-controller unit and a source readout IC according to an embodiment.

FIG. 6 is a diagram illustrating waveforms of clocks and data transmitted and received between a micro-controller unit and a source readout IC according to an embodiment.

Referring to FIG. 6, a micro-controller unit, which is a master, and a source readout IC, which is a slave, may perform synchronization communication using a clock CLK.

The micro-controller unit may produce a clock CLK and master data MDAT. The clock CLK may be produced from the clock signal that is generated by an internal oscillator (not shown). The micro-controller unit may transmit master data MDAT to the source readout IC in accordance with the clock CLK. For example, the master data MDAT may be synchronized at a rising edge at which the clock CLK changes from a low level to a high level. The source readout IC may read the value of the master data MDAT at the timing of the rising edge of the clock CLK. Also, the master data MDAT may be synchronized at a falling edge at which the clock CLK changes from a high level to a low level. The source readout IC may read the value of the master data MDAT at the timing of the falling edge of the clock CLK.

The source readout IC may receive a delayed clock CLK and delayed master data MDAT. Here, since the clock CLK and the master data MDAT are transmitted from the master to the destination slave through the same path at the same timing, the delay time of the clock CLK and the delay time of the master data MDAT may be the same. In FIG. 6, the delay time may be represented as "Td".

The source readout IC may generate slave data SDAT. Conventionally, the source readout IC may transmit the slave data SDAT to the micro-controller unit in accordance with the clock CLK that is used by the micro-controller unit to transmit the master data MDAT. For example, the slave data SDAT may be synchronized at the rising edge or the falling edge of the clock CLK generated by the micro-controller unit, and may be transmitted to the micro-controller unit.

Like the source readout IC, the micro-controller unit may also receive delayed slave data SDAT. Here, if the source readout IC transmits slave data SDAT to the micro-controller unit using the clock CLK generated by the micro-controller unit, the slave data SDAT may be delayed once more by the delay time Td of the master data MDAT, based on the clock CLK. Accordingly, the delay time of slave data SDAT may be 2Td (Td+Td=2Td).

Comparing the master data MDAT with the slave data SDAT based on the clock CLK, since the master data MDAT is synchronized with the clock CLK and has the same delay as the same, the source readout IC has no difficulty in reading the master data MDAT, but since the slave data SDAT is delayed from the clock CLK by 2Td, the micro-controller unit may have problems in reading the slave data SDAT. For example, the source readout IC is able to sample all the first to fourth transmission bits TXD1 to TXD4 at four rising edges of the clock CLK, but the micro-controller unit is able to sample only the first to third reception bits RXD1 to RXD3 although the micro-controller unit must sample the first to fourth reception bits RXD1 to RXD4.

Accordingly, since the micro-controller unit, which is a master, and the source readout IC, which is a slave, use the clock CLK that is used in transmission of the master data MDAT in order to transmit the slave data SDAT, the micro-controller unit may not correctly sample the slave data SDAT, thereby causing a problem with errors in reading the data.

Figure 7:
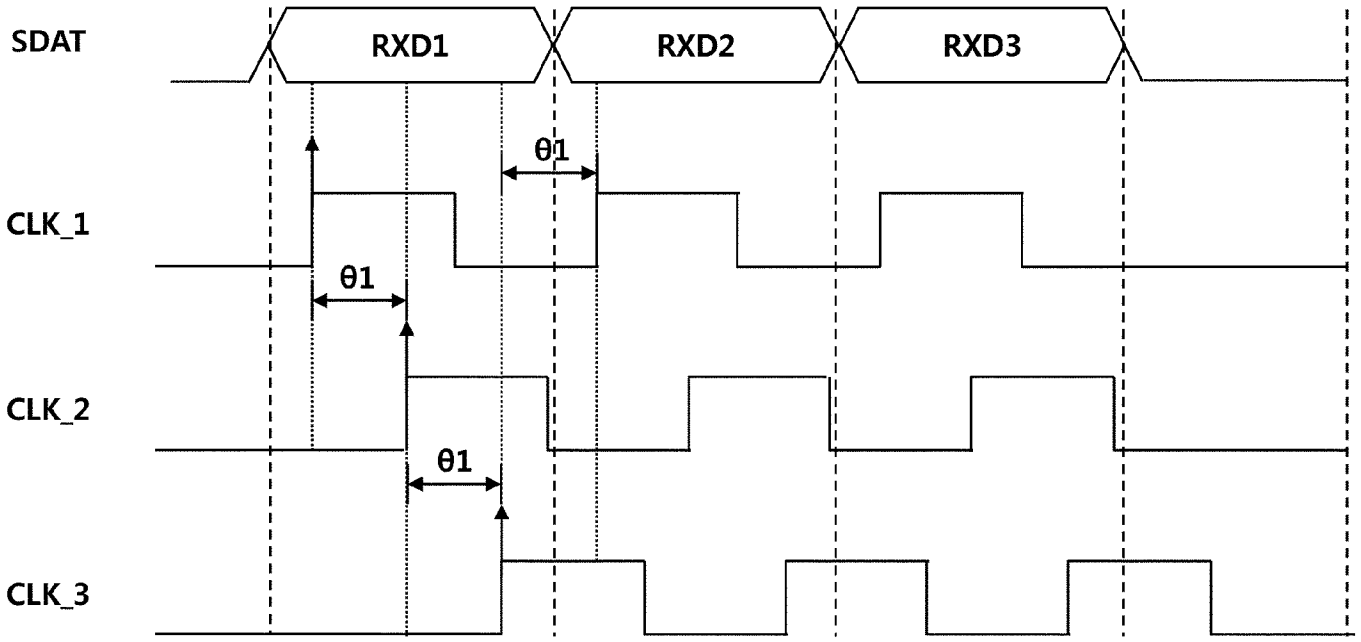
FIG. 7 is a diagram illustrating an operation in which a micro-controller unit samples delayed slave data according to an embodiment.

FIG. 7 is a diagram illustrating an operation in which a micro-controller unit samples delayed slave data according to an embodiment.

Referring to FIG. 7, the micro-controller unit may transmit a clock CLK and first data synchronized with the clock CLK, and may receive second data. The source readout IC may generate the second data, and may transmit the same to the micro-controller unit. The micro-controller unit may determine a plurality of sampling points, may sample a signal corresponding to the second data at the plurality of sampling points to generate a plurality of pieces of sampling data, and may restore the second data from the plurality of pieces of sampling data.

Here, the first data may correspond to the master data MDAT. The second data may correspond to the slave data SDAT. The restoration of the slave data SDAT may be implemented by sampling a slave signal corresponding to the slave data SDAT at a plurality of sampling points to generate a plurality of pieces of sampling data and comparing and selecting the plurality of pieces of sampling data. The result of comparing and selecting the plurality of pieces of sampling data may include the same value as that of the second data, that is, the slave data SDAT.

Specifically, if the delayed slave signal is transmitted to the micro-controller unit, the slave signal may be sampled by the micro-controller unit.

The slave signal may be delayed by a specific amount of time (for example, 2Td), and may then be transmitted to the micro-controller unit that is a master. Although the slave signal may reach the micro-controller unit while being delayed from the clock CLK used in transmission of a master signal corresponding to the master data MDAT, the slave signal may have the same frequency as that of the clock CLK.

In addition, the micro-controller unit may sample and read the slave signal. In order to determine the sampling timing of the slave signal, the micro-controller unit may use a duplicated clock.

The micro-controller unit may generate at least two or more duplicated clocks. In one embodiment, the micro-controller unit may generate three or more duplicated clocks, and may sample the slave signals. A plurality of sampling values may be obtained by sampling any one bit from among the slave signal using a plurality of duplicated clocks, and the plurality of sampling values may have as many Os or is as the number of samplings. The micro-controller unit is required to determine a final bit value from among "0" and "1". In this case, the micro-controller unit may determine "0" or "1", which is the majority of the plurality of sampling values (for example, half the number of sampling values or more), to be the final bit value. Accordingly, since it is possible to select the majority from among "0" and "1" only when there is a large number of candidate groups (i.e., a large number of sampling values), the number of duplicated clocks necessary for sampling may be two or more. Preferably, since one of "0" and "1" is required to be more dominant or appear more frequently than the other thereof, the number of duplicated clocks may be an odd number of 3 or more. The determination as to the final bit value from the plurality of sampling values will be described later.

In order to duplicate a clock, if a slave signal is received, the micro-controller unit may duplicate the clock CLK that was previously generated for the master signal, thereby generating a plurality of sampling clocks CLK_1, CLK_2, and CLK_3. The micro-controller unit may use the clock CLK per se, which is the target of duplication, as one of the sampling clocks CLK_1, CLK_2, and CLK_3.

The sampling clocks CLK_1, CLK_2, and CLK_3 may have phase differences therebetween, and the phase differences may be uniform between the sampling clocks. For example, the sampling clocks CLK_1, CLK_2, and CLK_3 may have the same phase difference of θ1, and θ1 may be 120 degrees. That is, the phase difference between the first sampling clock CLK_1 and the second sampling clock CLK_2, the phase difference between the second sampling clock CLK_2 and the third sampling clock CLK_3, and the phase difference between the first sampling clock CLK_1 and the third sampling clock CLK_3 may be θ1 of 120 degrees, respectively.

The micro-controller unit may sample the slave signal using the sampling clocks CLK_1, CLK_2, and CLK_3. The micro-controller unit may read the slave signal at the respective edges of the sampling clocks CLK_1, CLK_2, and CLK_3. The sampling time may be the rising edge or the falling edge. Here, for convenience, a description will be made based on the rising edge.

For example, the micro-controller unit may sample the first reception bit RXD1 of the slave signal at the rising edges of the first to third sampling clocks CLK_1, CLK_2, and CLK_3. The micro-controller unit may read the first reception bit RXD1 at the rising edges of the respective clocks. Subsequently, the micro-controller unit may read other reception bits RXD2 and RXD3 by sampling the same at the rising edges of the respective clocks.

Figure 8:
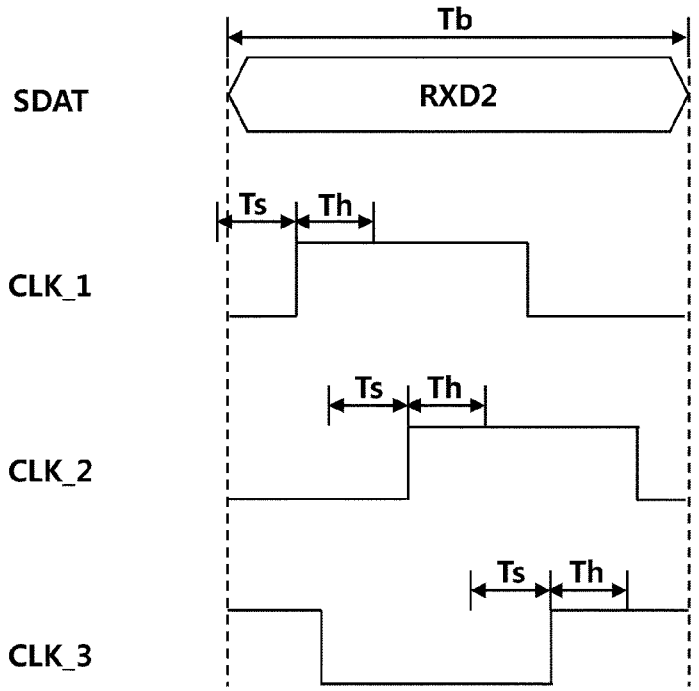
FIG. 8 is a diagram illustrating sampling having errors according to an embodiment.

FIG. 8 is a diagram illustrating sampling having errors according to an embodiment.

Referring to FIG. 8, in order to sample a slave signal corresponding to slave data SDAT, a plurality of sampling clocks CLK_1, CLK_2, and CLK_3 may have specific conditions. The conditions may be that predetermined periods of the plurality of sampling clocks CLK_1, CLK_2, and CLK_3 are required to overlap the data section of the slave signal. The data section is an area including touch data transmitted from the source readout IC, and may include a bit period Tb. At the same time, the conditions may be that predetermined periods of the plurality of sampling clocks CLK_1, CLK_2, and CLK_3 are required to overlap the bit period Tb of the slave signal. The predetermined period may be defined as an effective period for the micro-controller unit to recognize the slave signal. A bit value of the bit period Tb may be accurately sampled only when the effective period falls within the bit period Tb. If the effective period falls out of the bit period Tb, an error may occur in sampling a bit value of the bit period Tb.

The micro-controller unit may duplicate the clocks such that the plurality of sampling clocks CLK_1, CLK_2, and CLK_3 has effective periods. The effective period may be a period of time, and may include a setup period Ts and a hold period Th. In order for the micro-controller unit to perform sampling at a certain sampling time (e.g., at a rising edge), the setup period Ts and the hold period Th on both sides of the sampling time are required to fall within the bit period Tb.

The setup period Ts and the hold period Th are periods in which the levels of the plurality of sampling clocks CLK_1, CLK_2, CLK_3 fluctuate and the fluctuated levels are stabilized, and may be effective periods for obtaining correct sampling data. The setup period Ts may be a minimum time for which the slave signal must be stabilized before the rising edge of the sampling clock. The hold period Th may be a minimum time for which the slave signal must be stabilized after the rising edge of the sampling clock. Alternatively, the setup period Ts and the hold period Th may be a minimum time for which the slave signal must be stabilized before and after the falling edge. The setup period Ts and the hold period Th may be effective periods for correct sampling at the rising edge or the falling edge.

If the effective periods fall out of the data section of the slave signal, a data aligning unit of the micro-controller unit may generate a plurality of pieces of sampling data using data different from the data included in the data section.

That is, if the setup periods Ts and the hold periods Th of the plurality of sampling clocks CLK_1, CLK_2, and CLK_3 fall out of the bit period Tb, the sampling in accordance with the clock may be an error, and the micro-controller unit may obtain a sampling value having an error according thereto. For example, since the first sampling clock CLK_1 falls out of the bit period Tb in FIG. 8, a first sampling value according to the first sampling clock CLK_1 may have an error. Thus, the micro-controller unit obtains a sampling value having an error.

If the effective periods fall within the data section of the slave signal, the data aligning unit of the micro-controller unit may generate a plurality of pieces of sampling data using data included in the data section.

That is, if the setup periods Ts and the hold periods Th of the plurality of sampling clocks CLK_1, CLK_2, and CLK_3 fall within the bit period Tb, the sampling in accordance with the clock may be normal, and the micro-controller unit may obtain a normal sampling value according thereto. For example, since the second sampling clock CLK_2 does not fall out of the bit period Tb in FIG. 8, a second sampling value according to the second sampling clock CLK_2 is normal. The micro-controller unit may obtain a normal sampling value. A third sampling value according to the third sampling clock CLK_3 is also normal.

The micro-controller unit may select one of a plurality of sampling values, and determine the selected sampling value to be slave data (SDAT). The plurality of sampling values may have a bit value "0" or "1", and the micro-controller unit may select a final bit value that is the majority from the two bit values. The selected sampling value may be any one of "0" and "1".

For example, if a slave signal is received from the source readout IC, the micro-controller unit may generate sampling clocks CLK_1, CLK_2, and CLK_3, and may sample the slave signal in accordance with the sampling clocks CLK_1, CLK_2, and CLK_3, thereby extracting first to third sampling values. The first to third sampling values may be bit values "0" or "1", and may have any one bit value in duplicate. In FIG. 8, if the micro-controller unit samples the second reception bit RXD2 of a slave signal according to first to third sampling clocks CLK_1, CLK_2, and CLK_3 having the same phase differences therebetween, and if the value of the second reception bit RXD2 is "0", a first sampling value sampled according to the first sampling clock CLK_1 may be "1", a second sampling value sampled according to the second sampling clock CLK_2 may be "0", and a third sampling value sampled according to the third sampling clock CLK_3 may be "0".

The reason why the first sampling value is "1", which is different from other sampling values, is that the setup period Ts and the hold period Th of the first sampling clock CLK_1 fall out of the bit period Tb of the second reception bit RXD2, so the first sampling value has an error. If the setup period Ts and the hold period Th of the first sampling clock CLK_1 fall within the bit period Tb of the second reception bit RXD2, and if the first sampling value is normal, the first sampling value may be "0". However, since the first sampling value has an error, it becomes "1" instead of "0".

In addition, the micro-controller unit may obtain first to third sampling values {1,0,0} according to the first to third sampling clocks CLK_1, CLK_2, and CLK_3 in the above example. However, if the timings in the first to third sampling clocks CLK_1, CLK_2, and CLK_3 are different from those in the above example, the micro-controller unit may obtain first to third sampling values {0,0,0}, {0,0,1}, and {0,1,0}.

Therefore, if the first to third sampling values are {0,0,0}, {0,0,1}, {0,1,0}, and {1,0,0}, the micro-controller unit may select the bit value "0", which is the majority, from among the bit values "0" and "1", and may determine the same to be the bit value of the second reception bit RXD2 of the slave signal. This is due to the fact that the sampling value "1" indicates an error, which may result from the sampling of the second reception bit RXD2 in the state in which the effective periods (i.e., the setup period Ts and the hold period Th) of the sampling clock, according to which the sampling value is derived, fall out of the bit period Tb.

On the other hand, if the micro-controller unit samples the second reception bit RXD2 of a slave signal according to first to third sampling clock CLK_1, CLK_2, and CLK_3 having the same phase differences therebetween, and if the value of the second reception bit RXD2 is "1" and first to third sampling values are {0,1,1}, {1,0,1}, {1,1,0}, and {1,1,1}, the micro-controller unit may select "1", which is the majority, from among "0" and "1", and may determine the same to be the bit value of the second reception bit RXD2 of the slave signal. This is due to the fact that the sampling value "0" indicates an error, which may result from the sampling of the second reception bit RXD2 in the state in which the effective periods (i.e., the setup period Ts and the hold period Th) of the sampling clock, according to which the sampling value is derived, fall out of the bit period Tb.

As described above, since the micro-controller unit determines the final slave signal from a plurality of sampling values (or selects any one of the bit values "0" and "1"), the more the sample values, the more noticeable the frequencies of "0" and "1". For example, if there are two sampling values with combinations {0.1} and {1,0}, it may be difficult to determine the second reception bit RXD2 of a slave signal from the bit values "0" and "1". However, if there are many sampling values, a larger number of normal sampling values than the sampling values having errors may be obtained. Therefore, the micro-controller unit may determine the bit value, which appears more frequently, to be the second reception bit RXD2 of the slave data SDAT.

Figure 9:
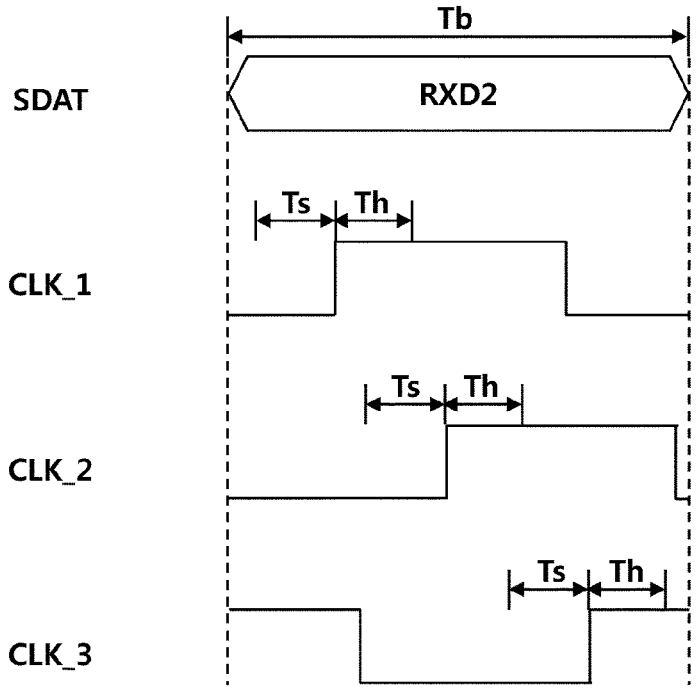
FIG. 9 is a diagram illustrating sampling with no errors according to an embodiment.

FIG. 9 is a diagram illustrating sampling with no errors according to an embodiment.

Referring to FIG. 9, the conditions for all of a plurality of sampling clocks CLK_1, CLK_2, and CLK_3 to sample a slave signal corresponding to slave data SDAT (e.g., the conditions in which the setup periods Ts and the hold periods Th must fall within the bit period Tb) may be satisfied.

For example, if the setup periods Ts and the hold periods Th of the plurality of sampling clocks CLK_1, CLK_2, and CLK_3 fall within the bit period Tb, the sampling according to the clock is normal, and the micro-controller unit may obtain a normal sampling value according thereto. In FIG. 9, since the first sampling clock CLK_1 does not fall out of the bit period Tb, the first sampling value according to the first sampling clock CLK_1 is normal. The micro-controller unit may obtain a normal sampling value. The second and third sampling values according to the second and third sampling clocks CLK_2 and CLK_3 are also normal.

Even if a plurality of normal sampling values without errors is extracted, the micro-controller unit may select one of the plurality of sampling values, and may determine the selected sampling value to be slave data SDAT. If there is an error, the plurality of sampling values may have bit values of alternating "0" and "1", but if there is no error, the plurality of sampling values may have bit values having only one of "0" and "1". The micro-controller unit may select a bit value having only one of "0" and "1".

For example, if the micro-controller unit samples the second reception bit RXD2 of a salve signal according to first to third sampling clocks CLK_1, CLK_2, and CLK_3 having the same phase differences therebetween, and if the value of the second reception bit RXD2 is "0" and the first to third sampling values are {0,0,0}, the micro-controller unit may select the sole value "0" from among "0" and "1", thereby determining the same to be the bit value of the second reception bit RXD2 of the slave signal. In this case, the first to third sampling values are normal and have no error.

The first to third sampling values have the sole value "0" because all of the setup periods Ts and the hold periods Th of the first to third sampling clocks CLK_1, CLK_2, and CLK_3 are synchronized within the bit period Tb of the second reception bit RXD2.

On the other hand, if the micro-controller unit samples the second reception bit RXD2 of a slave signal according to first to third sampling clocks CLK_1, CLK_2, and CLK_3 having the same phase differences therebetween, and if the value of the second reception bit RXD2 is "1" and the first to third sampling values are {1,1,1}, the micro-controller unit may select the sole value "1" from among "0" and "1", and may determine the same to be the bit value of the second reception bit RXD2 of slave data SDAT. In this case, the first to third sampling values are normal and have no error.

Figure 10:
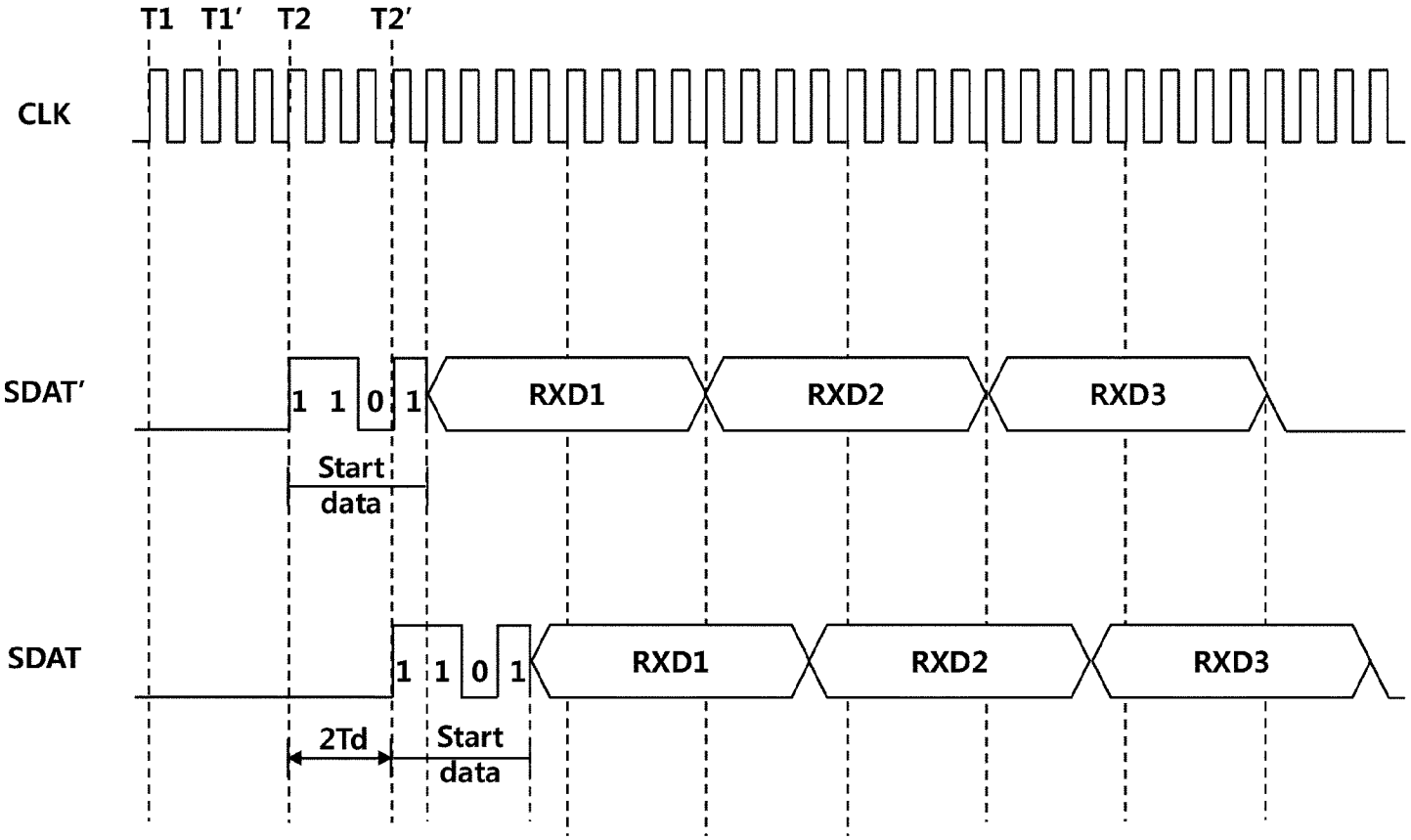
FIG. 10 is diagram illustrating an operation in which the micro-controller unit aligns slave data according to an embodiment.

FIG. 10 is diagram illustrating an operation in which the micro-controller unit aligns slave data according to an embodiment.

Referring to FIG. 10, the micro-controller unit may align slave data SDAT in units of data (for example, in units of bytes or words). The micro-controller unit may recognize slave data SDAT in units of bytes or words through data alignment.

In order to align the slave data SDAT, the micro-controller unit may find a specific pattern from the slave data SDAT. The pattern may be located in the area of the most significant bit (MSB) of the slave data SDAT. If the micro-controller unit recognizes the pattern, a series of bits after the pattern may be divided into predetermined units of bits, and the divided bits may be recognized by bytes or words.

For example, the slave data SDAT may include first to third reception bits RXD1 to RXD3 and start data before the same. The start data may be a series of bit strings. In FIG. 10, the start data may be represented as {1,1,0,1}. If the micro-controller unit finds the start data, the micro-controller unit may align the first to third reception bits RXD1 to RXD3 after the start data by bytes or words. The start data indicates the time at which alignment starts, and may correspond to the pattern for the alignment of the slave data SDAT.

Meanwhile, the micro-controller unit, which is a master, may predict the time at which the slave data SDAT is transmitted from the source readout IC, which is a slave. Since the source readout IC transmits the slave data SDAT after receiving a read command from the micro-controller unit, the micro-controller unit may wait to receive the slave data SDAT only after transmitting the read command, instead of waiting to receive the slave data SDAT at all times.

For example, if the micro-controller unit transmits a read command to the source readout IC at time T1, the micro-controller unit may wait to receive the slave data SDAT. Thereafter, the source readout IC may start outputting the slave data SDAT at time T1'.

The micro-controller unit may predict the reception of the slave data SDAT. Since the micro-controller unit transmits a read command before reception, the micro-controller unit is able to predict the time at which the slave data SDAT arrives. Here, SDAT' may represent the slave data predicted by the micro-controller unit.

Although the micro-controller unit predicts that the slave data SDAT' will reach the micro-controller unit at time T2, the slave data SDAT may actually reach the micro-controller unit at time T2'. The transmission of the slave data SDAT may be delayed by 2Td, and the slave data SDAT may reach the micro-controller unit at time T2', which is delayed from time T2 by 2Td.

Figure 11:
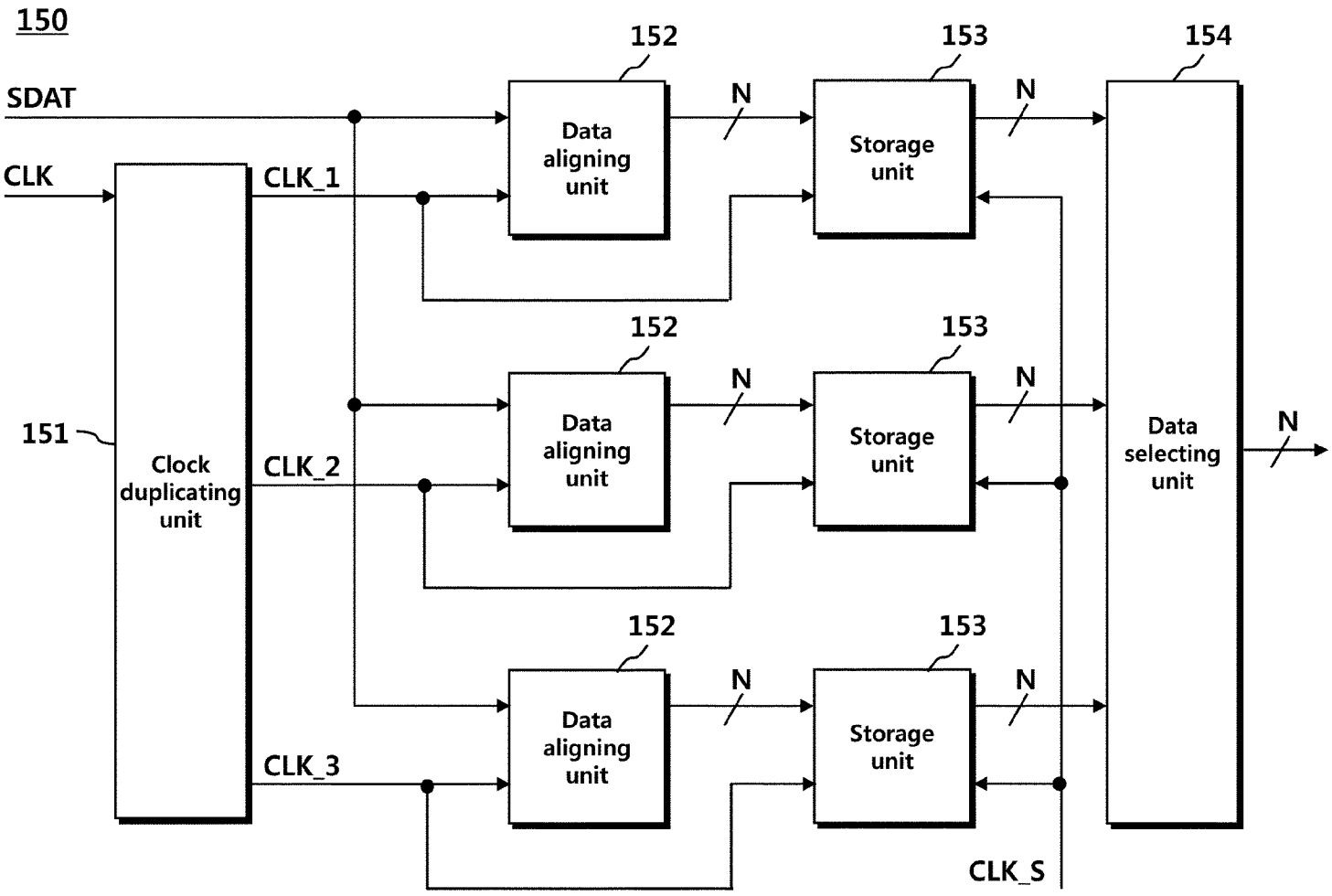
FIG. 11 is a diagram illustrating the configuration of a micro-controller unit according to an embodiment.

FIG. 11 is a diagram illustrating the configuration of a micro-controller unit according to an embodiment.

Referring to FIG. 11, the micro-controller unit 150 may include a clock duplicating unit 151, a plurality of data aligning units 152, a plurality of storage units 153, and a data selecting unit 154. The data aligning unit 152 may receive a signal corresponding to first data, may determine a plurality of sampling points, and may sample the signal corresponding to the first data at the plurality of sampling points, thereby generating a plurality of pieces of sampling data. The data selecting unit 154 may generate second data, which occupies the majority of the plurality of pieces of sampling data, and may restore the first data from the second data.

Here, the first data may correspond to slave data SDAT. The second data may correspond to sampling data, which is one of the plurality of pieces of sampling data and occupies the majority thereof, and ultimately may include the same value as that of the first data, that is, the slave data SDAT.

The micro-controller unit 150 may receive a slave signal corresponding to the slave data SDAT, and the slave signal may be transmitted to each of the data aligning units 152.

The clock duplicating unit 151 may receive a clock CLK, and may duplicate the clock CLK to generate a plurality of sampling clocks CLK_1, CLK_2, and CLK_3. The plurality of sampling clocks CLK_1, CLK_2, and CLK_3 may be transmitted to the data aligning units 152 and the storage units 153.

Each data aligning unit 152 may align data based on a received sampling clock among the sampling clocks CLK_1, CLK_2, and CLK_3. First, the data aligning unit 152 may recognize the start point of the data, and may divide the data. The data aligning unit 152 may sample the data for each bit using the received sampling clock, thereby generating sampling values. The data aligning unit 152 may generate a set of sampling values by collecting the sampling values for all bits. The set of sampling values may have a serial form. The data aligning unit 152 may convert the set of sampling values from a serial form to a parallel form.

For example, the data aligning unit 152 receiving the first sampling clock CLK_1 may find start data from the slave data SDAT, and may divide the slave data SDAT in units of bytes or words. In addition, the data aligning unit 152 may sample the divided data for each bit to generate first sampling values. The data aligning unit 152 may collect the first sampling values for all bits to generate a set of first sampling values. The data aligning unit 152 may convert the set of first sampling values from a serial form to a parallel form.

The slave data SDAT (the set of sampling values) in the parallel form may be stored in the storage unit 153, and the data selecting unit 154 may read out the set of sampling values from the storage unit 153. The storage and reading with respect to the storage unit 153 may be performed in a first-in-first-out (FIFO) manner. The storage unit 153 may include a plurality of flip-flops or shift registers therein for the first-in-first-out manner. The storage unit 153 may receive an input of a clock CLK_S, thereby operating flip-flops or shift registers, and may store a set of sampling values, or may output the same to the data selecting unit 154.

For example, a set of first sampling values in a parallel form may be stored in the storage unit 153, and may then be shifted from the storage unit 153 to be output in a first-in-first-out manner. The sets of second and third sampling values may also be stored in the corresponding storage units 153, and may then be output.

Then, the data selecting unit 154 may receive a plurality of pieces of slave data SDAT (sets of sampling values) in a parallel form the storage units 153, may compare the plurality of sets of sampling values for each bit, and may select a bit value, which is the majority or appears more than half the number of times the values appear, for each bit. The data selecting unit 154 may collect only the bit values selected for the respective bits, and may determine the same to be the slave data SDAT to be read.

For example, as shown in FIG. 7, the slave data SDAT may include the first to third reception bits RXD1 to RXD3, and the first to third reception bits RXD1 to RXD3 may have bit values {0,1,0}. In addition, the data aligning unit 152 may sample the slave signal for each of the first to third reception bits RXD1 to RXD3 according to the first sampling clock CLK_1, and may generate a set of first sampling values having bit values {1,1,0}. Likewise, the data aligning unit 152 may generate a set of second sampling values {0,1,0} based on the second sampling clock CLK_2, and may generate a set of third sampling values {0,1,0} based on the third sampling clock CLK_3. The data aligning unit 152 may convert the sets of first to third sampling values into the sets thereof in a parallel form.

Here, the sampling value of the first reception bit RXD1 according to the first sampling clock CLK_1 is "1" rather than "0", which may indicate that an error has occurred. As described above, the occurrence of the error may be caused by the effective periods of the first sampling clock CLK_1 falling out of the bit period of the first reception bit RXD1.

In this case, the data selecting unit 154 may determine the sampling values for the respective reception bits. The data selecting unit 154 may compare the bit values for each reception bit using the set of first sampling values {1,1,0}, the set of second sampling values {0,1,0}, and the set of third sampling values {0,1,0}. As a result of sampling the first reception bit RXD1 three times, "1" appears once and "0" appears twice, so the frequency of "0" is more than half the number of times the values appear. The data selecting unit 154 may select the bit value "0" for the first reception bit RXD1.

Similarly, as a result of sampling the second reception bit RXD2 three times, "1" appears three times, so the frequency of "1" is more than half the number of times the values appear. The data selecting unit 154 may select the bit value "1" for the second reception bit RXD2. As a result of sampling the third reception bit RXD3 three times, "0" appears three times, so the frequency of "0" is more than half the number of times the values appear. The data selecting unit 154 may select the bit value "0" for the third reception bit RXD3.

Accordingly, the data selecting unit 154 may determine {0,1,0}, which is obtained by collecting the bit values selected from the first to third reception bits RXD1 to RXD3, to be slave data SDAT to be read.

As described above, even if there is an error in some sampling values, the data selecting unit 154 may compare the sampling values having errors with other sampling values, and may select a sampling value, which is the majority, thereby ensuring normal sampling.

What is claimed is:

1. A display device comprising:

a micro-controller unit configured to transmit a master signal together with a clock; and a source readout integrated circuit (IC) configured to restore master data from the master signal according to the clock and transmit a slave signal generated according to the clock to the micro-controller unit, wherein the micro-controller unit is configured to sample the slave signal according to a plurality of sampling clocks having a same frequency as that of the clock to generate a plurality of pieces of sampling data, and restore slave data using the plurality of pieces of sampling data.

2. The display device of claim 1, wherein the plurality of sampling clocks have different phases.

3. The display device of claim 1, wherein the source readout IC does not transmit a clock corresponding to the slave data.

4. The display device of claim 2, wherein the micro-controller unit samples the slave signal at rising edges or falling edges of the plurality of sampling clocks.

5. The display device of claim 1, wherein the micro-controller unit determines data, which occupies a majority of the plurality of pieces of sampling data, to be the slave data.

6. The display device of claim 1, wherein the micro-controller unit generates N sampling clocks (N is a natural number of 3 or more).

7. The display device of claim 6, wherein N is an odd number, and wherein the micro-controller unit compares bit values of the plurality of pieces of sampling data, and determines a bit value occupying a majority of the bit values of the plurality of pieces of sampling data to be a bit value of the slave data.

8. The display device of claim 1, wherein the plurality of sampling clocks has a uniform phase difference therebetween.

9. The display device of claim 1, wherein the micro-controller unit and the source readout IC transmit and receive the clock through a signal line in which a delay occurs.

10. The display device of claim 1, wherein the micro-controller unit divides the slave signal into predetermined units, and samples the divided slave signal.

11. The display device of claim 10, wherein the slave signal comprises a pattern indicating a start time of a predetermined unit, and wherein the micro-controller unit divides the slave signal based on the pattern.

12. The display device of claim 1, wherein the micro-controller unit transmits a read command using the master data, and waits to receive the slave data after transmission of the read command.

13. The display device of claim 1, wherein the slave data is data in a serial form, and wherein the micro-controller unit converts the plurality of pieces of sampling data from the serial form into a parallel form, stores the parallel form of the plurality of pieces of sampling data in a storage unit, compares the parallel form of the plurality of pieces of sampling data stored in the storage unit, and restores the slave data.

14. The display device of claim 1, wherein one of the plurality of sampling clocks is the clock.

15. A micro-controller unit for transmitting, to a slave device, a master signal together with a clock, the micro-controller unit comprising:

a plurality of data aligning units configured to receive a slave signal from the slave device and generate sampling data by sampling the slave signal according to a sampling clock having a same frequency as that of the clock; and a data selecting unit configured to compare the sampling data generated by the plurality of data aligning units to restore slave data included in the slave signal.

16. The micro-controller unit of claim 15, wherein the sampling clock is the clock or a clock having a phase different from that of the clock.

17. The micro-controller unit of claim 16, wherein the data aligning unit samples the slave signal at rising edges or falling edges of the sampling clock.

18. The micro-controller unit of claim 15, further comprising a storage unit in which the sampling data is stored and from which the sampling data is read out by the data selecting unit in a first-in-first-out (FIFO) manner.

19. The micro-controller unit of claim 18, wherein the slave data is data in a serial form, and wherein the data aligning unit converts the sampling data from the serial form into a parallel form, and stores the parallel form of the sampling data in the storage unit.

* * * * *